United States Patent [19]

Kozyrski et al.

[11] Patent Number: 4,809,849

[45] Date of Patent: Mar. 7, 1989

[54] STACK OF ASYMMETRIC FASTENERS AND COMBINATION THEREOF WITH COOPERATING MAGAZINE

[75] Inventors: Vincent T. Kozyrski, Plainville; Alan R. Peters, Milford; Ralph B. Shaw, Manchester, all of Conn.

[73] Assignee: The Fletcher-Terry Company, Farmington, Conn.

[21] Appl. No.: 23,224

[22] Filed: Mar. 9, 1987

Related U.S. Application Data

[62] Division of Ser. No. 841,174, Mar. 19, 1986, Pat. No. 4,699,307.

[51] Int. Cl.[4] ..... B65D 85/24

[52] U.S. Cl. ..... 206/343; 411/443; 411/442; 411/446; 411/477; 411/922; 227/156

[58] Field of Search ..... 411/443, 442, 451, 446, 411/447, 477, 499, 496, 922; 206/343, 345; 227/156

[56] References Cited

U.S. PATENT DOCUMENTS

| | | | |
|---|---|---|---|
| 166,661 | 8/1875 | Van Wagenen | 411/442 |
| 166,662 | 8/1875 | Van Wagenen | 411/442 |
| 252,379 | 1/1882 | Hubbard . | |
| 1,654,371 | 12/1927 | Goodstein | 411/443 |
| 1,674,437 | 6/1928 | Hubbard . | |
| 1,744,700 | 1/1930 | Hubbard et al. . | |
| 2,086,922 | 7/1937 | Peterson . | |
| 2,234,448 | 3/1941 | Posnack . | |
| 2,294,463 | 9/1942 | Krantz . | |
| 2,468,821 | 5/1949 | Goodstein . | |
| 2,522,931 | 9/1950 | Curtiss . | |
| 2,886,815 | 5/1959 | Young . | |
| 3,022,509 | 2/1962 | DeMan . | |
| 3,347,439 | 10/1967 | Doherty . | |
| 3,586,231 | 6/1971 | Wilson . | |
| 3,654,164 | 2/1972 | Wurth | 411/443 |
| 4,040,325 | 8/1977 | Monacelli | 206/343 X |
| 4,071,141 | 1/1978 | Gray | 206/343 X |
| 4,189,082 | 2/1980 | Solomon . | |
| 4,342,414 | 8/1982 | Grzeika et al. . | |
| 4,369,909 | 1/1983 | Grzeika . | |
| 4,432,484 | 2/1984 | Maestri . | |
| 4,519,533 | 5/1985 | Jirovetz | 227/156 X |

FOREIGN PATENT DOCUMENTS

| | | | |
|---|---|---|---|
| 518522 | 4/1953 | Belgium | 411/443 |

OTHER PUBLICATIONS

Product Literature of Elpa s.a.s. di Elio Maestri & Co. of Milano, Italy.

Product Literature of Salco, Inc. of Syracuse, New York.

*Primary Examiner*—Lloyd A. Gall
*Assistant Examiner*—Curtis B. Brueske
*Attorney, Agent, or Firm*—Ira S. Dorman

[57] ABSTRACT

A stack of fasteners cooperatively define a lateral groove which cooperates with an elongate rib to orient the stack in a magazine of a driving machine.

2 Claims, 6 Drawing Sheets

STACK OF ASYMMETRIC FASTENERS AND COMBINATION THEREOF WITH COOPERATING MAGAZINE

This is a divisional of co-pending application Ser. No. 841,174, filed on Mar. 19, 1986, now U.S. Pat. No. 4,699,307.

BACKGROUND OF THE INVENTION

Machines points and like fasteners, of the kind used by framers and glaziers, are well known in the art, and in some instances they employ magazine inserts to accommodate points of various sizes and shapes For example, U.S. Pat. No. 3,347,439 discloses a fastening tool which employs interchangeable magazines and driving blades; U.S. Pat. No. 4,189,082 employs replaceable barrel-like magazines; and U.S. Pat. Nos. 4,342,414 and 4,369,909 provide inserts that are capable of different orientations for that purpose.

Whereas points used for framing are desirably relatively long, to provide adequate overlap of the backing material, glaziers points are desirably quite short, to ensure that they will be hidden by the putty applied to the window frame. In both cases, the points should be relatively wide to afford good holding power, and they should be fairly thin but yet thick enough to provide adequate strength and resistance to bending or jamming in the driver.

In the ideal case, the fasteners will be driven so as to bear tightly upon the underlying glass or backing piece, which is best accomplished by inserting them from positions of surface contact thereupon. Not only should the driving machine afford that advantage, but manual machines should of course also be comfortable and nonfatiguing in use, relatively lightweight and designed for optimal hand gripping angles, durable, reliable, attractive and economical to manufacture.

Accordingly, it is a broad object of the present invention to provide a novel machine for driving framer's and glazier's points, and like fasteners, which is highly effective and reliable in use.

A more specific object is to provide such a machine which is capable of driving either of two sizes of points, and which may employ a unique, invertible magazine which is quickly and easily removed and reinserted, to accomplish that purpose.

Another specific object is to provide such a machine which is so constructed as to drive the fasteners from positions in which they are in surface contact with the glass or backing piece being secured thereby.

An additional object is to provide a driving machine having the foregoing features and advantages, which is also constructed to afford optimal angles between the operating trigger and handle frame, for comfort and nonfatiguing use, which is attractive, durable, reliable, and economical to manufacture It is a further object of the invention to provide a novel stacked assembly of framers' and glaziers' points, which are fabricated with an asymmetric edge character so as to cause deflection upon entry into the workpiece and thereby tight surface contact with the underlying glass or backing member, and a magazine which contains and supports them in proper orientation in the driving machine

SUMMARY OF THE INVENTION

It has now been found that certain of the foregoing and related objects of the invention are achieved by the provision of a machine for driving framer's and glazier's points, and like fasteners, comprising a body including guide means defining a channel, and a hammer assembly supported by the guide means for reciprocal movement within the channel The hammer assembly includes a push plate having an element movable along a path between first ad second positions during reciprocation of the hammer assembly, and capable of driving contact with a fastener at both of two levels with respect to the body. Means on the body supports a stack of fasteners disposed to intercept the push plate at a location intermediate the extreme positions of the contact element, the hammer assembly guide means being adapted to support the lowermost fastener of the stack at one of the levels and at the intermediate location, and to release the fastener to the other of the levels at a location outwardly thereof The machine also includes means disposed outwardly of the first position of the push plate element for deflecting an outwardly driven fastener from the one level to the other level, and means for reciprocating the hammer assembly to move the push plate element between the first and second positions thereof. Thus, with the contact element of the push plate in its first position, the stacked fasteners will be supported upon the plate. Actuation of the reciprocating means to move the element to its second position will permit the lowermost fastener to move to a position supported upon the guide means at the first level, and actuation thereof to return the element to its first position will cause the element to drive the fastener against the deflecting means, toward the other level and outwardly of the machine.

In the preferred embodiments, the contact element will comprise a surface at one end of the push plate, and the guide means will have an opening through it at the outward location to permit such release of the lowermost fastener The push plate will advantageously be a generally planar strip having a rib extending longitudinally from its one end and providing a component of the contact element which acts at the second of the two levels, another portion of the strip providing a component to act at the first level, the guide means having a groove therein communicating with its opening to accommodate the rib for sliding movement therein.

The reciprocating means will generally include biasing means acting to urge the hammer assembly in the outward direction, and a manually operated trigger for moving the hammer assembly inwardly against the force of the biasing means, which will normally be a main spring. In most instances the trigger will be pivotably mounted upon the body, and will have a contact portion that moves through an arcuate path adjacent the hammer assembly. The latter will desirably include a pawl that is pivotably mounted thereupon, with an element disposed to move into and out of the path of the trigger contact portion, and it will have secondary biasing means for urging the pawl toward the path. The contact portion and the pawl element will be adapted to interengage during an initial phase of movement of the contact portion through its arcuate path, to permit the trigger to move the hammer assembly inwardly against the force of the main biasing means, and to thereafter effect release thereof and to permit the contact portion to displace the pawl against the force of the secondary biasing means during return of the trigger The machine will desirably additionally comprise a follower assembly, including a follower piece mounted upon the body, and means for urging the follower piece into the supporting means provided, for exerting force upon a stack of fasteners contained therewithin to urge them toward the hammer assembly guide means. The machine body will have means thereon defining a follower channel for guiding movement of the follower piece between positions withdrawn from the supporting means and a position therewithin. The follower piece will have a nose portion for contacting the fasteners in the supporting means, a head portion slidably mounted within the follower channel of the body, and spaced elements on the head portion engaged within the follower channel for constraining the follower piece against pivotal movement therewithin. In such a case, the follower channel-defining means will have a recessed section into which one of the spaced elements can be inserted when the follower piece is in a withdrawn position, and allowing pivotable movement of the piece This will permit the follower piece to be pivoted to effect engagement of the one element within the recessed section, to retain it in its withdrawn position.

Most desirably, the fastener supporting means of the machine will comprise a magazine that is independent of the machine body, and it and the body will have cooperating means for securing them in assembly with one another The deflecting means will generally comprise a ramp element on an end portion of the magazine, and will provide a surface that is oblique to the axis of the push plate path and disposed thereacross. Preferably, the magazine will be elongated, and will have a channel extending through it dimensioned and configured for passage of the fasteners while constraining them to a predetermined orientation.

In particularly preferred embodiments, the cooperating means provided on the machine body and the magazine will permit assembly of the magazine with either end of its channel disposed adjacent the push plate, and one end portion of the magazine will have an end surface of greater dimension than the other, in the direction of reciprocal movement of the push plate, to thereby adapt the one end portion to support fasteners for movement along the end surface thereof which are longer than those for which the other end portion is adapted Each of the end portions will have a deflecting ramp element on it to provide an inclined surface adjacent its end surface.

Other objects of the invention are attained by the provision of a stack of substantially identical, registered, and disengageably joined asymmetric fasteners adapted for use with a driving machine Each of the fasteners is comprised of a generally planar, elongate body having a tip portion at one end, for penetration into a workpiece, and a contact portion at the opposite end adapted for contact by drive means of a driving machine. The peripheral lower edge of the body is smooth, relative to the coextending peripheral upper edge thereof, at least along the tip portion, and serves to generate a frictional differential therebetween which tends to induce a directional change in the fastener upon being driven into a workpiece. The body also has structural means for constraining the fastener to the orientation in which the lower edge thereof is disposed toward the driving means, when the stack is inserted into the machine magazine,.

In preferred embodiments, the constraining means will comprise a notch formed into one side edge of the body of each fastener, the fasteners being registered to cooperatively form a continuous groove along one side of the stack. Most desirably, the stack will additionally include a strip of adhesive material running along the fasteners and deposited within the groove that they provide to join the fasteners in assembly.

DETAILED DESCRIPTION OF THE ILLUSTRATED EMBODIMENTS

Figure 1:
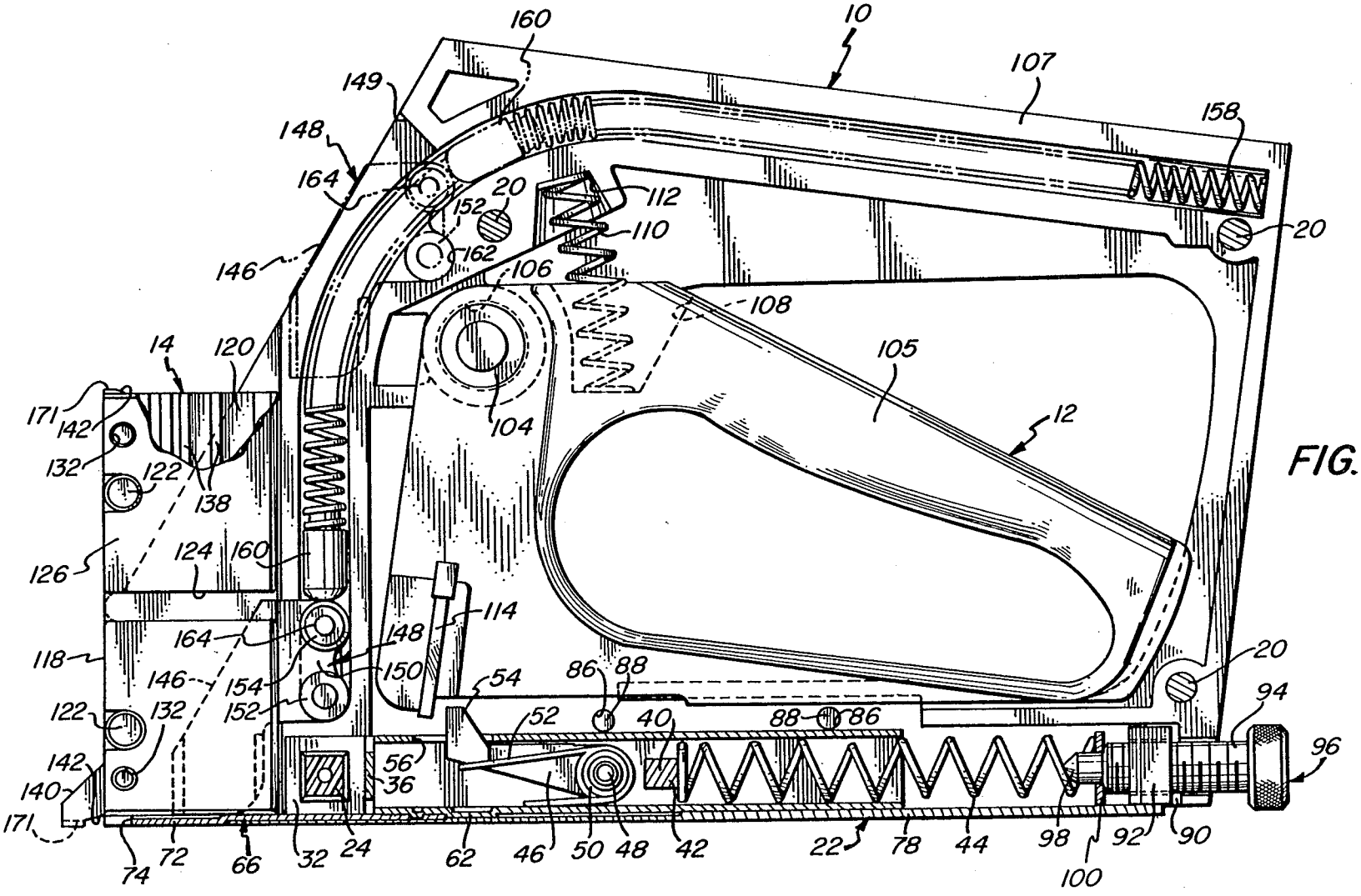
FIG. 1 is a vertical sectional view of a machine for driving framer's and glazier's points embodying the present invention, showing the magazine for the stack of points partially broken away, and showing the follower assembly in fully inserted (full line) and fully withdrawn (phantom line) positions.
Figure 3:
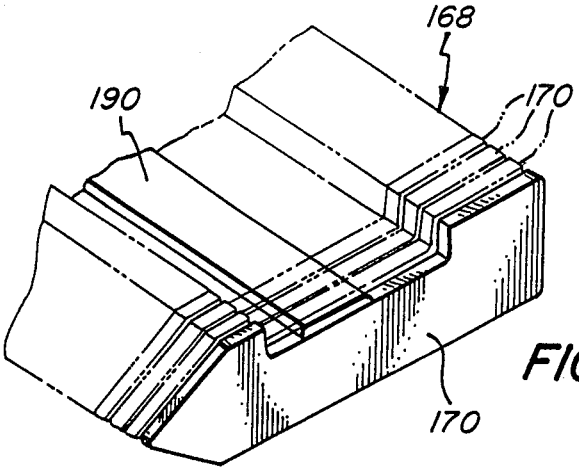
FIG. 3 is a fragmentary perspective view of a stack of framer's points suitable for use in accordance with the invention, all but the end-most point being shown in phantom line.
Figure 11:
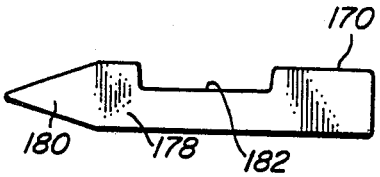
FIGS. 11 and 12 are plan and side elevational views of a framer's point suitable forgive in the machine of the invention.
Figure 12:
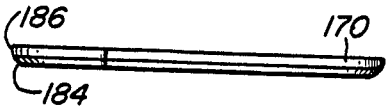
Figure 13:
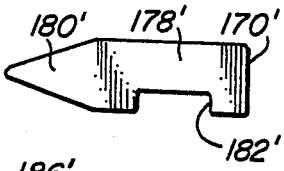
FIGS. 13 and 14 similar views of a glazier's point suitable for use therein.

Turning now in detail to the drawings, therein illustrated is a machine embodying the present invention consisting of a frame-like handle, generally designated by the numeral 10, a trigger generally designated by the numeral 12 pivotably mounted upon the handle, and a magazine generally designated by the numeral 14 slidably engaged within the forward portion thereof. The handle consists of a right-hand section 16 and a left-hand section 18, which are secured to one another by screws 20. A U-shaped elongated metal channel, generally designated by the numeral 22, is mounted between the handle sections 16, 18 at the bottom of the machine, and is in part held in place by a transverse stop bar 24, which is received within square openings 26 formed through the sidewall elements 28, 30 of the channel; the stop bar 24 is in turn secured between the handle halves by screws 20, and carries a transverse bumper 32 made of a tough and durable resilient material, such as polyurethane. The opposite end of the channel 22 is secured by bosses (not shown) which project from the inside surfaces of the handle sections into the square openings 87.

A hammer assembly is slidably mounted within the channel 22, and consists of an elongated box-like tubular housing, generally designated by the numeral 34, having inwardly folded flange elements 36 substantially closing one end and being open at the opposite end thereof The sidewall elements 38 of the housing 34 are formed with square openings 40, within which is seated a transversely extending stop plate 42. The main drive coil spring 44 bears upon the stop plate 42, and is received within the passage of the housing with its rearward end portion extending outwardly thereof.

A pawl, generally designated by the numeral 46, is pivotably mounted upon a transverse pin 48 which extends through a bore formed in its inner end portion 50 and upon which is mounted a double torsion spring 52, the ends of the pin 48 being engaged in apertures 49 of the housing sidewalls 38. The spring 52 acts upon the bottom wall 60, and bears upon the outer portion of the pawl to urge its nose element 54 through the rectangular opening 56 formed in the top wall 58 of the housing 34.

The bottom wall 60 of the housing is formed with generally rectangular and generally circular, downwardly extending protuberances 62, 64, respectively, which cooperatively engage the elongated strip-like push plate, generally designated by the numeral 66. The latter has, at its rearward end, a straight edge portion 68 which abuts against the rectangular protuberance 62, and it has a circular opening 70 formed therethrough within which is engaged the circular protuberance 64. In this manner, the push plate 66 is affixed for reciprocal sliding movement with the housing 34.

The forward end portion of the push plate 66 has a downwardly formed rib element 72 extending from the forward edge thereof, which edge is, as a result, comprised of a depending semi-circular component 74 and side components 76, which extend laterally therefrom at a level thereabove. The bottom wall 78 of the channel 22 is formed to accommodate the push plate 66 and has, for that purpose, a narrow groove 80 which is of substantially the same width as the plate 66. The forward end of the bottom wall 78 has an outer slot section 82 therethrough which extends across the full width of the groove 80, and a narrower inner section 84 which extends therefrom partway along the length of the groove, and is boardered by narrow wall elements 85; as will be appreciated, the inner slot section 84 is dimensioned and configured to slidably receive the rib 74 of the push plate 66.

Central sections of the sidewalls 30 of the channel 22 are slightly higher than the remainder thereof, and are formed with transversely aligned apertures 86 for mounting guide pins 88; as best seen in FIG. 1, the pins 88 serve to retain the housing 34 of the hammer assembly for sliding reciprocal movement within the channel 22. Elements 90 of the sidewalls 30 at the rear end of the channel are bent inwardly to lie behind a square nut 92, which is seated within the channel and in turn threadably engages the shaft 94 of an adjustment knob, generally designated by the numeral 96; the handle sections 16, 18 are relieved at 102 as well to permit passage of the shaft 94. The tip 98 of the knob is of reduced diameter, and seats a washer 100 against which the outer end of the main spring 44 bears. By turning the adjustment knob 96, compression of the spring 44 can be varied to thereby control the level of force that is exerted by the hammer assembly.

The trigger 12 is of open, frame-like form, and is pivotably mounted by engagement of laterally extending circular bosses 104 within reenforced openings 106 in the two body sections The gripping part 105 and the upper section 107 of the handle are disposed at what are believed to be optimal angles, (e.g., of about 30° and 8°, respectively, relative to the bottom surface) for comfortable and nonfatiguing use. A recess 108 extends into the upper side of the trigger and seats one end of a coil spring 110, the opposite end of which is seated within a recess 112, cooperatively formed by the handle sections 16, 18, to exert a downward bias upon the trigger A wear plate 114, desirably formed of case-hardened steel, is mounted upon the lower forward end portion of the trigger 12 and protrudes downwardly in front of the nose element 54 of the hammer assembly pawl 46. The components are so configured that, when the trigger is squeezed to elevate it from the position shown in FIG. 1, the protruding portion of the wear plate 114 will contact the nose element 54 and push the hammer assembly rearwardly against the force of the main spring 44. At the point that the wear plate (which of course moves through an arcuate path) clears the nose portion of the pawl, the hammer assembly will be disengaged, and driven forwardly. Release of force upon the trigger will permit the spring 110 to return it to its original position, with the pawl 46 yielding and being forced downwardly into the housing 34 through contact with the opposite side of the trigger elements Such operation is quite conventional in machines of this sort, with the exception of the arrangement by which the pawl 36 is maintained in elevated position in the arcuate path of movement of the wear plate 114. In some instances the main spring 44 has been employed to impart upward bias to such a pawl, thereby creating excessive resistance to return of the trigger, due to the strength of the main spring, and consequently causing undue wear upon the contact surfaces.

Figure 4:
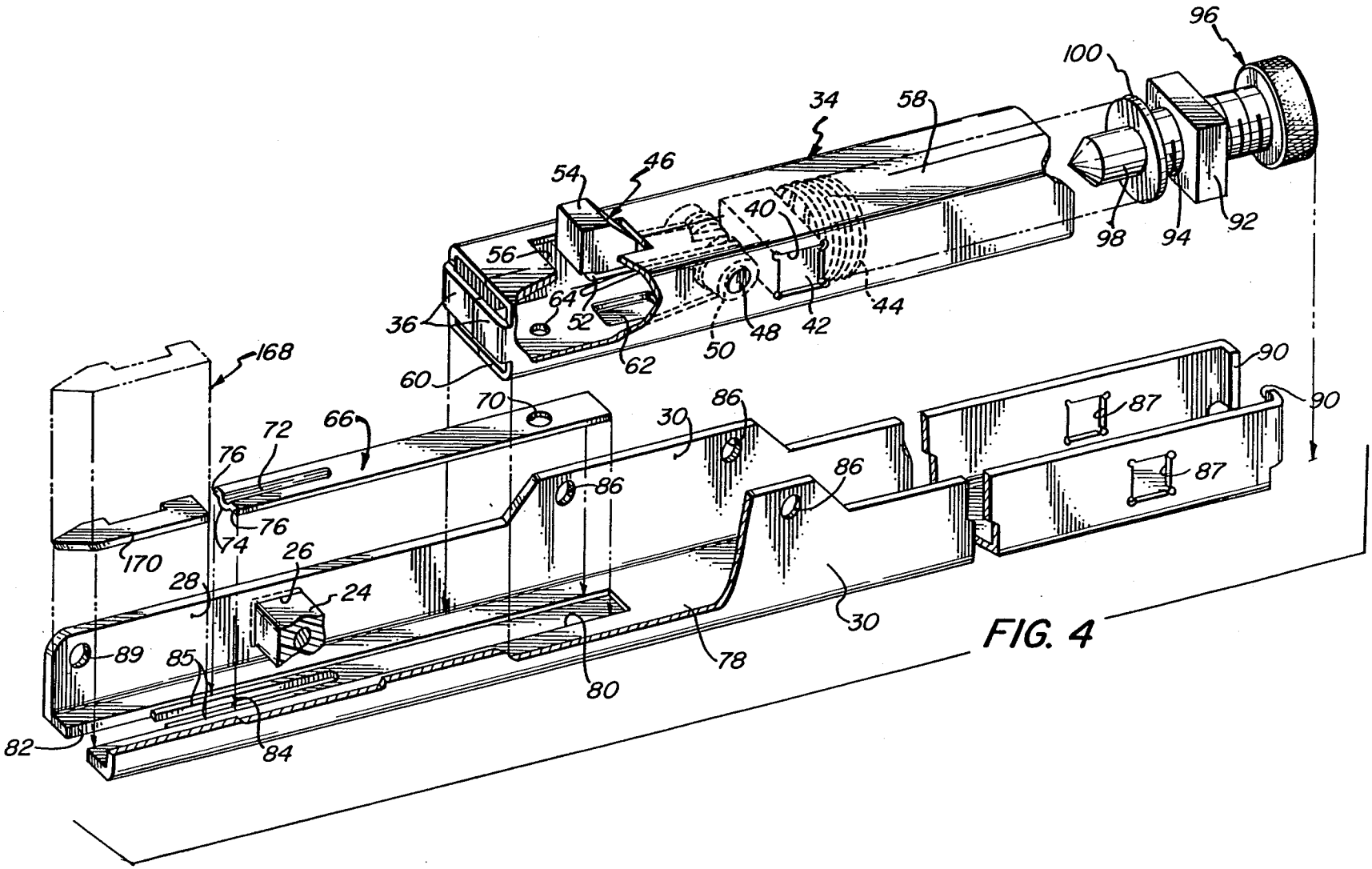
FIG. 4 is a fragmentary, exploded perspective view, in partial section and drawn to an enlarged scale, showing the hammer assembly and guide channel of the machine, and also showing a stack of points positioned for driving by the push plate.
Figure 5:
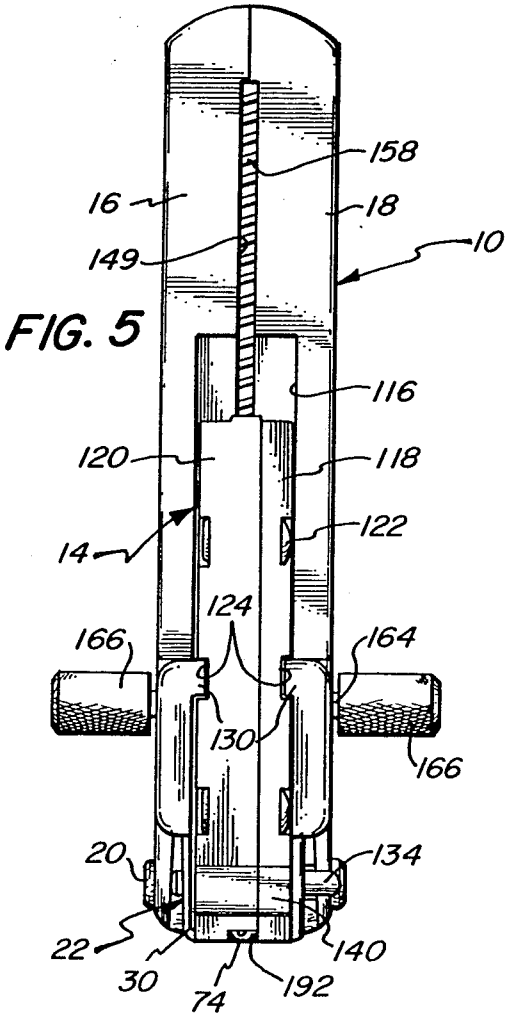
FIG. 5 is an end view of the forward portion of the machine.
Figure 7:
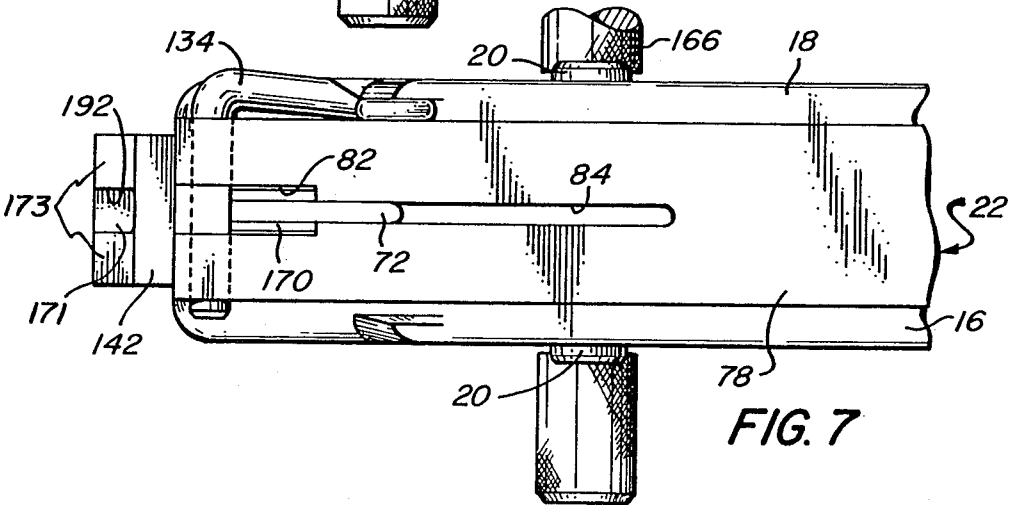
FIG. 7 is a fragmentary bottom view of the forward portion of the machine to the scale of FIG. 6.
Figure 15:
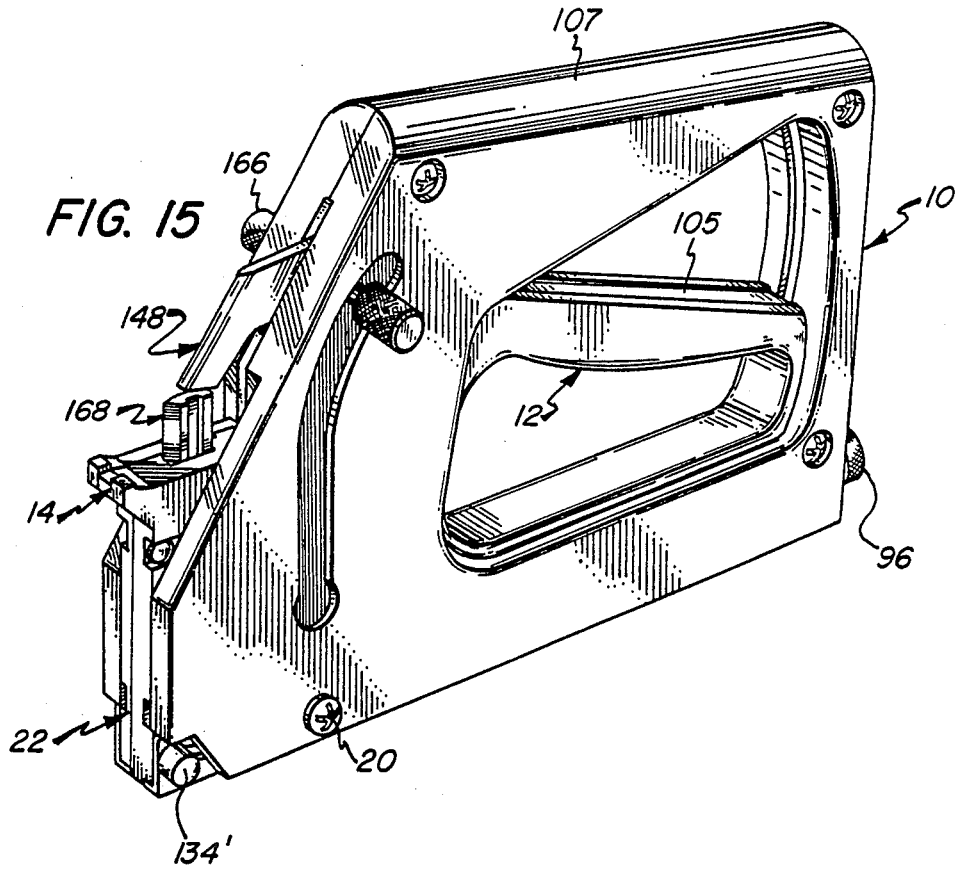
FIG. 15 is a perspective view of a machine embodying the invention, with the magazine loaded with a stack of points and in condition for operation, the magazine being inverted, end-to-end, from the orientation shown in FIG. 1.

The forward portions of the handle sections 16, 18, are spaced from one another to define a large rectangular recess 116 therebetween, within which the guide block or magazine 14 is seated, the latter desirably being fabricated from two sintered metal sections 118, 120, secured to one another by suitable means, such as rivets 122. As best seen in FIG. 5, a slot 124 extends along each side of the magazine at a level half-way between its opposite end portions 126, 128 and serves to slidably engage a corresponding rail element 130, one of which extends inwardly from each handle section 16, 18; an alternative construction, in which two slots and rails extend along each side, is shown in FIG. 15. In this manner, the magazine 14 is slidably engaged upon the handle 10, and is seated within the recess 116 upon the forward portion of the underlying metal channel 22; as will be appreciated, by virtue of this construction the magazine can readily be removed and reinserted in inverted orientation Each end portion 126, 128 of the magazine is provided with a transverse aperture 132, within which may be received a locking pin which may take either the L-shaped form shown in FIGS. 5 and 7 and numbered 134, or the round-headed form 134' illustrated in FIG. 15; transversely aligned apertures 89 (only one of which is seen in FIG. 4) are provided in the forward end of the channel 22 to receive the pin 134, 134' and thereby secure the magazine in place.

Figure 6:
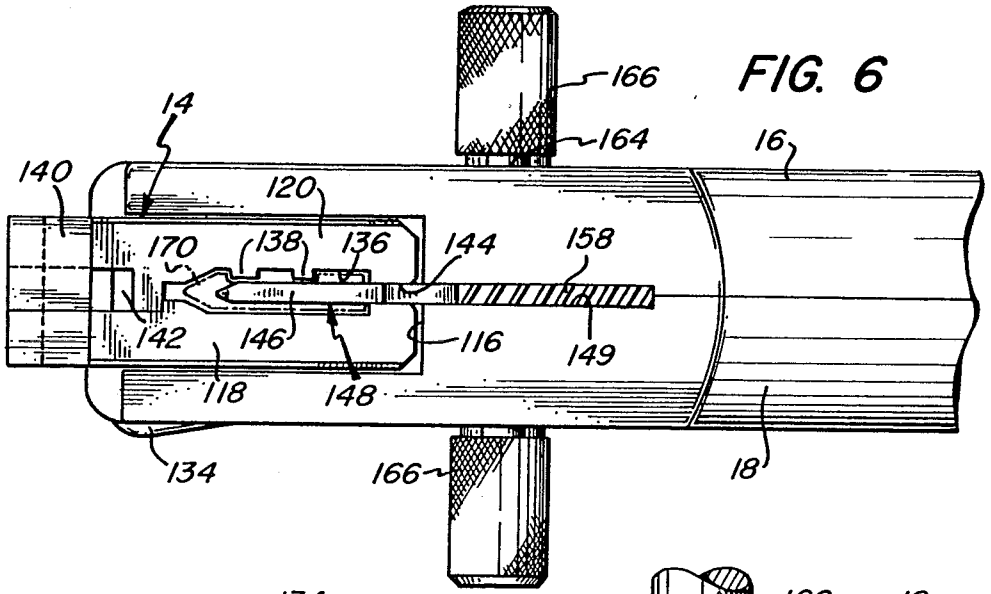
FIG. 6 is a fragmentary plan view showing the forward end portion of the machine and drawn to a scale enlarged from that of FIG. 5.

A channel or passageway 136 extends longitudinally entirely through the magazine 14 As best seen in FIG. 6, it has a substantially rectangular cross sectional configuration with a tapered forward end portion; the symmetry of the configuration of the channel 136 is interrupted by a pair of internal ribs 148, which extending longitudinally within the passageway.

It will be noted that the end portion 128 of the magazine has a nose element or extension 140 which projects beyond the forward edge thereof, and that both end portions 126, 128 have ramp elements thereon. The ramp elements provide inclined surfaces 142 adjacent the opposite ends of the channel 136 and between the flat surfaces 171, 172, the function of which will be described in detail hereinbelow.

It will also be noted that the magazine 14 has a longitudinal gap 144 extending along its innermost portion and communicating with the passageway 136 extending therethrough. The gap 144 permits entry of the nose portion 146 of a follower piece, generally designated by the numeral 148, mounted upon the handle and extending through the slot 149 along the forward portion thereof. The head portion 150 of the follower piece 146 has a pair of laterally extending circular lugs 152, 154 at spaced locations thereon and on each side thereof (only one side being visible, however) adapted to slidably engage within a follower channel 156, which extends along the forward and upper parts of the handle and provides a track to guide the piece 148 therealong. A long coil spring 158 is seated within the channel 156, and a cap element 160 is engaged within the forward end thereof to bear upon the top of the follower piece, thereby exerting a bias urging it downwardly into the magazine passageway 136.

At a position intermediate its ends, the follower channel 156 is formed with notched or recessed sections 158, which are dimensioned and configured to receive the circular lugs 152 on both sides of the follower piece. Consequently, when the follower piece is elevated sufficiently, rotation thereof will pivot the lugs 152 into the recessed sections 162, thereby retaining the follower piece in that withdrawn position to facilitate loading of the magazine; otherwise, the follower piece is constrained against pivotable movement within the follower channel 156 due to the engagement of the lugs 152, 154 along the surfaces defining it. To permit facile elevation of the follower piece, and pivoting thereof to bring the lugs 152 into retaining engagement, a shaft 164 having knurled knobs 166 on its opposite ends extends transversely through the head portion 156.

Operation of the machine is best described with reference to FIGS. 8–10. The stack of assembled points, generally designated by the numeral 168, is contained within the passageway 136 of the magazine 14, and is urged downwardly by the follower piece 148 (to rest upon the upper surface of the push plate 66 when the machine is in its normal, at rest condition). Moving the hammer assembly to the position shown in FIG. 8, by operation of the trigger 12 as hereinabove described, will slide the push plate 66 from under the lowermost of the points in the stack 168, permitting it to drop into the portion of the groove 80 that lies over the inner slot section 84, to rest upon the lateral bottom wall elements 85 of the channel 22; as will be appreciated, the groove 80 is of substantially the same width as the points 170, to permit them to be slidably seated therewithin.

When the wear plate 114 of the trigger 12 clears the end of the nose portion 54 of the pawl 46, the main spring 44 will act upon the stop plate 42 in the housing 34 to propel the hammer assembly forwardly. The side components 76 at the forward end of the push plate 66 will contact the trailing edge of the point 170, driving it forwardly within the channel 80 along the surfaces of the channel elements 85 and the confronting surface 172 of the magazine, and thereafter against the inclined surface 142; the surface 142 will deflect the leading end of the point downwardly into the outer section 82 of the channel slot, to achieve the transitory position illustrated in FIG. 9.

When the trailing edge of the point clears the ends of the elements 85, the point will drop through the outer slot section 82 upon the glass 174. Further forward movement of the push plate 66 will drive the point from that position into the wood of the frame 176, as shown in FIG. 10. As will be appreciated, at the end of the drive stroke the flange elements 36 of the housing 34 will impact upon the resilient bumper 32, which will serve to cushion the force.

Figure 8:
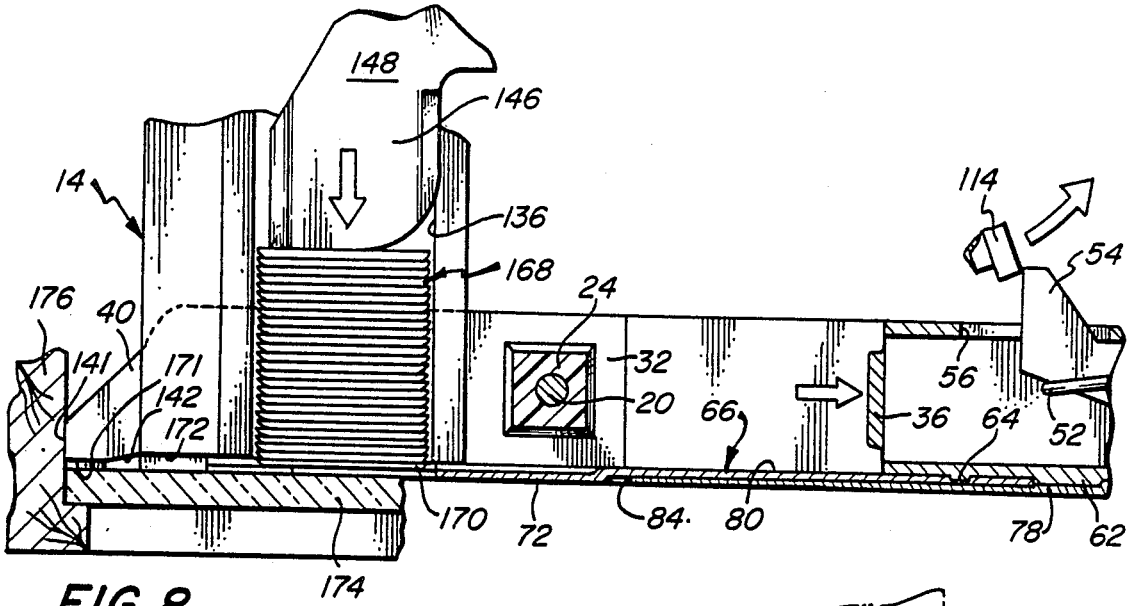
FIG. 8 is a fragmentary sectional view showing the forward portion of the machine in use for framing, with the hammer assembly in position at the commencement of the driving stroke, portions of a frame and the glass to be secured thereto also being illustrated.
Figure 9:
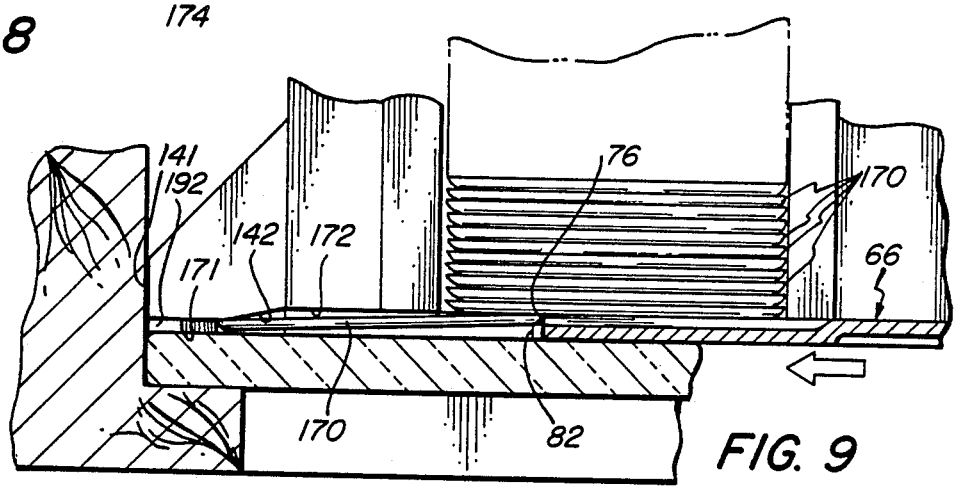
FIG. 9 is view similar to FIG. 8, drawn to a scale enlarged therefrom and showing the push plate of the hammer assembly at an intermediate point of the drive stroke.
Figure 10:
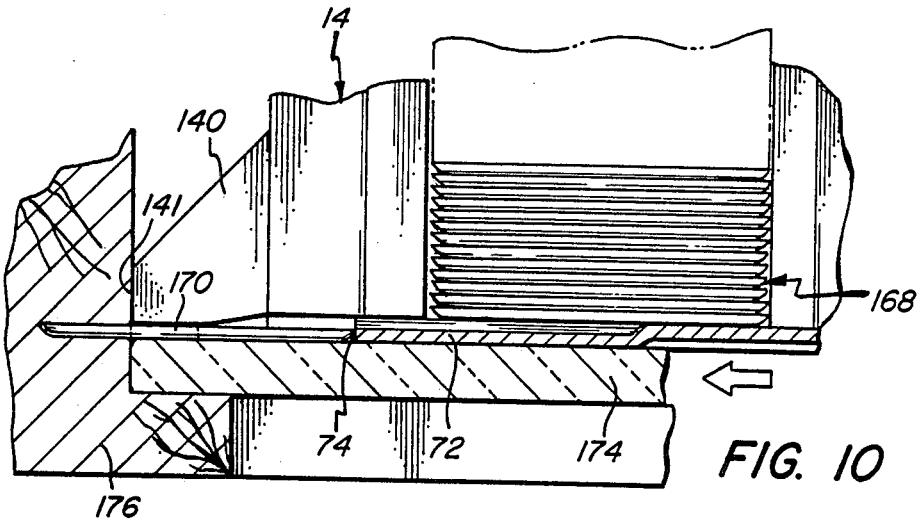
FIG. 10 is a view similar to FIG. 9, showing the completion of the drive stroke with the point partially embedded in the material of the frame.

It is important to note that, in the relationships depicted in FIGS. 8 and 9, the upper side edge components 76 of the push plate 66 bear upon the point and serve to drive it forwardly, as described. In the condition shown in FIG. 10, however, in which the point has dropped through the outer slot section 82 to the lower level (i.e., upon the surface of the glass), the curved edge component 74 contacts the point and completes the driving operation. Thus, since the point is driven at two levels, the drive element is configured to exert force thereupon at both of them.

The preferred form of the points is best appreciated with additional reference to FIGS. 11–14. As can, be seen, they have relatively rectangular body portions 178, ½ with a pointed tip portion 180, 180' at the head or forward end. The side of the body portion is formed with a notch 182, 182', and the lower peripheral edge 184, 184' is radiused to provide a degree of smoothness, as compared to the relatively sharp upper edge 186, 186'. It will be appreciated that the essential difference between the forms of points shown in FIGS. 11 and 12, on the one hand, and those shown in FIGS. 13 and 14, on the other, resides in the lengths of the body portions 178, 178'. and of the notches 182, 182', respectively, the longer points 170 being suited for framing applications and the shorter ones 170' being best adapted for glazing.

The relative degrees of resistance provided by the smooth and sharp edge elements 184, 186 produces deflection upon entry of the point into the workpiece material, which tends to divert the tip n the direction of the relatively sharp upper edge (i.e., upwardly, if the sharper edge is upwardly oriented). Thus, in the relationship to the workpiece assembly shown in FIGS. 8–10, this feature will cause the tail portion of the point to rotate downwardly to bear tightly against the surface of the glass 174. To ensure that such action occurs, the notch 182 is correlated to the edge condition for correct orientation. It is also necessary that the magazine be constructed to prevent loading of the stack of points in the wrong orientation and, in the illustrated embodiment, the longitudinally extending ribs 138 serve that purpose by cooperation with the point notches. This, of course, presupposes that the magazine has itself been properly oriented in the handle of the machine to receive the size of points to be driven, and a graphic representation, such as that shown at 188 in FIG. 2, may be provided to facilitate doing so; a similar depiction of the longer form of the points will generally be embossed or otherwise applied to the opposite end portion 126, as well.

The nose element 140 on the end portion 128 serves as an extension to provide the extra length necessary to adequately support the longer of the two versions of points; it also has a contact surface 141 thereon which abuts against the workpiece (see FIGS. 8–10) in use. It will be appreciated that the end element 173 affords the spacing above the work surface necessary to accommodate the points being driven, and that the element is slotted at 192 to permit them to pass therethrough along the surface 171.

Figure 2:
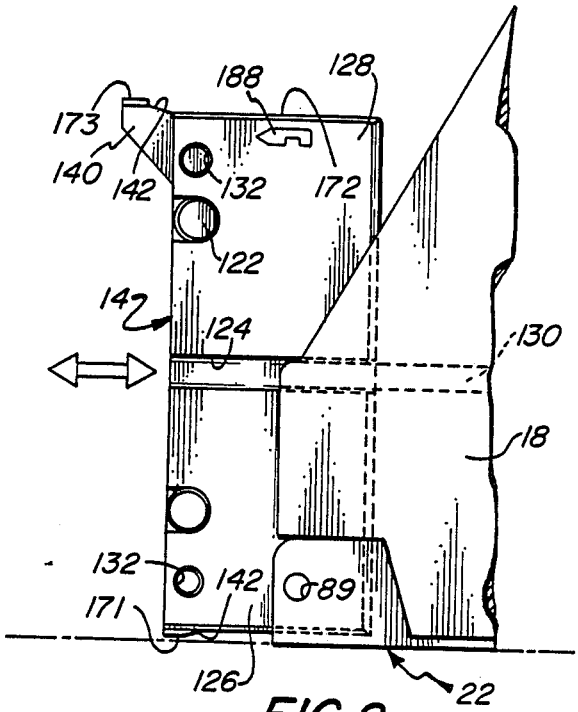
FIG. 2 is a fragmentary side elevational view of the machine of FIG. 1, showing the magazine partially removed from the handle and in a position inverted from that of FIG. 1.

As can be seen in FIG. 2, in the inverted position of the magazine the thickness of the metal channel 22 alone is relied upon for the necessary spacing above the work surface.

Figure 14:
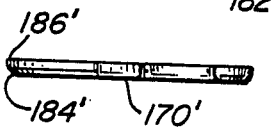

Turning finally to FIG. 14, therein illustrated is a preferred technique for securing the points 170 in assembly In accordance with it, a strip of adhesive material 190 extends along the length of the stack 168, lying within the channel cooperatively formed by the notches 182. This helps to avoid any interference that might otherwise be presented as a result of contact of the adhesive upon surfaces defining the passageway through the magazine, and is an added benefit of providing indentations in fasteners that are intended for use by driving them from a stacked assembly.

Although the foregoing description has stressed glazing and framing operation, it will be understood that the concepts hereof have broader applicability, and may be utilized in connection with fasteners other than points. Also, while preferred forms of points, magazines and driving machines have been shown and described, variations are encompassed, as will be evident to those skilled in the art. For example, although the edge character of the points may disirably be uniform about the entire periphery, to facilitate manufacture, the sharpness differential need be present only at the tip to cause the point to divert and perform as described.

Thus, it can be seen that the present invention provides a novel machine for driving framer's and glazier's points, and like fasteners, which is highly effective and reliable in use. The machine is capable of driving either of two sizes of points, and it employs a unique invertible guide block or magazine which is quickly and easily removed and reinserted. In addition, the machine is so constructed as to drive the fasteners from positions in which they are in surface contact with the glass or backing piece being secured, thereby ensuring tightness, and it may be constructed to afford optimal angles for the operating trigger and handle frame, for comfort and nonfatiguing use, as well as being attractive, durable, reliable, and economical to manufacture. The invention also provides a novel stacked assembly of framer's and glazier's points, which are fabricated with an asymmetric edge character so as to cause path diversion upon entry into the workpiece, thereby tending to produce downward deflection of the tail portion and, in turn, even tighter contact of the point upon the underlying glass pane or backing member, and it provides a magazine which contains and supports the points in proper orientation in the driving machine.

Having thus described the claims, what is claimed is:

1. In combination:

(a) a stack of substantially identical, registered and disengageably joined asymmetric fasteners adapted for use with a driving machine having driving means and a magazine therein for holding a stack of fasteners in a predetermined position relative to the driving means, each of said fasteners being comprised of a flat, elongate body having generally planar upper and lower surfaces, having a tip portion at one end, for penetration into a workpiece, and having a contact portion at the opposite end adapted for contact by the driving means of a driving machine, the peripheral lower edge of said body being smooth, relative to the coextending peripheral upper edge thereof, at least along said tip portion of said body, to generate a frictional differential therebetween tending to induce a directional change in said fastener upon being driven into a workpiece, said fasteners being disposed one on top of another with said upper and lower surfaces of adjacent fasteners in mutual contact, said body of each fastener also having structural orienting means on the periphery thereof for cooperating with structure of the magazine in the driving machine, when said stack is introduced thereinto, to permit insertion in only one orientation, in which said lower edges are disposed toward the driving means of the machine, said orienting means comprising a notch formed into one side edge of said body of each fastener, said notches being registered to cooperatively form a continuous groove along one side of said stack; and (b) a magazine for a driving machine containing said stack of fasteners, said magazine having a channel extending therethrough dimensioned and configured to permit passage of said stack of fasteners and having a longitudinally extending rib within said channel projecting into said groove of said stack, said groove preventing insertion of said stack in an orientation other than said one orientation.

2. The combination of claim 1 wherein said stack additionally includes a strip of adhesive material running along said fasteners and deposited within said groove to join said fasteners in assembly.

* * * * *